US010549546B2

(12) United States Patent
Suzuki

(10) Patent No.: US 10,549,546 B2
(45) Date of Patent: Feb. 4, 2020

(54) PRINTER, PRINTING SYSTEM INCLUDING THE SAME, AND COMPUTER-READABLE MEDIUM THEREFOR

(71) Applicant: Brother Kogyo Kabushiki Kaisha, Nagoya-shi, Aichi-ken (JP)

(72) Inventor: Yukinori Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/938,578

(22) Filed: Mar. 28, 2018

(65) Prior Publication Data

US 2018/0311970 A1 Nov. 1, 2018

(30) Foreign Application Priority Data

Apr. 27, 2017 (JP) ..... 2017-087779

(51) Int. Cl.

| | |
|---|---|
| ***B41J 2/36*** | (2006.01) |
| ***B41J 2/355*** | (2006.01) |
| ***B41J 2/325*** | (2006.01) |
| ***B41J 15/04*** | (2006.01) |
| ***B41J 32/02*** | (2006.01) |

(52) U.S. Cl.

CPC ..... *B41J 2/362* (2013.01); *B41J 2/325* (2013.01); *B41J 2/3555* (2013.01); *B41J 15/044* (2013.01); *B41J 32/02* (2013.01)

(58) Field of Classification Search

CPC ... B41J 2/362; B41J 2/355; B41J 2/325; B41J 15/044; B41J 32/02

See application file for complete search history.

(56) References Cited

U.S. PATENT DOCUMENTS

| | | | | |
|---|---|---|---|---|
| 5,492,420 | A * | 2/1996 | Nunokawa | B41J 3/4075 358/1.2 |
| 6,765,686 | B2 | 7/2004 | Maruoka | |
| 2003/0137680 | A1 | 7/2003 | Maruoka | |
| 2009/0311024 | A1 * | 12/2009 | Bandholz | B41J 17/36 400/223 |

(Continued)

FOREIGN PATENT DOCUMENTS

| | | | |
|---|---|---|---|
| EP | 0920184 | A2 | 6/1999 |
| JP | H02-255954 | A | 10/1990 |

(Continued)

*Primary Examiner* — Alessandro V Amari
*Assistant Examiner* — Kendrick X Liu
(74) *Attorney, Agent, or Firm* — Banner & Witcoff, Ltd.

(57) ABSTRACT

A printer includes a controller configured to perform a first printing process to control a thermal head to print a first image with a first density, store first print data for identifying the first image and first density data for identifying the first density into a first memory device attached to an attachment holder, when a second memory device storing second print data and second density data is attached to the attachment holder, acquire from the second memory device the second print data and the second density data stored into the second memory device by another printer, and perform a second printing process to control the thermal head to print a second image with a second density, the second image being identified based on the acquired second print data, the second density being identified based on the acquired second density data.

9 Claims, 6 Drawing Sheets

(56) References Cited

U.S. PATENT DOCUMENTS

| | | | | |
|---|---|---|---|---|
| 2012/0039651 | A1* | 2/2012 | Yamaguchi | B41J 3/4075<br>400/613 |
| 2014/0293336 | A1 | 10/2014 | Endo | |

FOREIGN PATENT DOCUMENTS

| | | | |
|---|---|---|---|
| JP | H08-149401 | A | 6/1996 |
| JP | H11-155118 | A | 6/1999 |
| JP | H11-215358 | A | 8/1999 |
| JP | 2010-179473 | A | 8/2010 |
| JP | 2010-194853 | A | 9/2010 |
| JP | 2012-116085 | A | 6/2012 |
| JP | 2014-191552 | A | 10/2014 |

* cited by examiner 751A (751)

| RIBBON COLOR | TAPE COLOR | RIBBON/ TAPE WIDTH | DENSITY DATA (TEST RESULTS) | | | | | DETERIORATION DEGREE |
|---|---|---|---|---|---|---|---|---|
| | | | LOWEST (3) | LOWER (4) | NORMAL (5) | HIGHER (6) | HIGHEST (7) | |
| BLACK | WHITE | 12mm | 2 | 3 | 4 | 5 | 6 | 1 |
| BLACK | WHITE | 6mm | 3 | 4 | 5 | 6 | 7 | 0 |

752A (752)

| RIBBON COLOR | TAPE COLOR | RIBBON/ TAPE WIDTH | PRINT DATA | DENSITY DATA |
|---|---|---|---|---|
| BLACK | WHITE | 12mm | PENCIL | 3 |
| | | | ERASER | 5 |
| | | | RULER | 5 |
| | | | SCISSORS | 5 |
| BLACK | WHITE | 6mm | CCC | 4 |
| | | | DDD | 4 |

1A

30

471

| | PRINT DATA | DENSITY DATA |
|---|---|---|
| 1 | PENCIL | 3 |
| 2 | ERASER | 5 |
| 3 | RULER | 5 |
| 4 | SCISSORS | 5 |

RIBBON COLOR: BLACK
TAPE COLOR: WHITE
TAPE WIDTH: 12mm

FIG. 4

471

| | PRINT DATA | DENSITY DATA |
|---|---|---|
| 1 | PENCIL | 3 |
| 2 | ERASER | 5 |
| 3 | RULER | 5 |
| 4 | SCISSORS | 5 |

RIBBON COLOR: BLACK
TAPE COLOR: WHITE
TAPE WIDTH: 12mm

30

1B 751B (751)

| RIBBON COLOR | TAPE COLOR | RIBBON/ TAPE WIDTH | DENSITY DATA (TEST RESULTS) | | | | | DETERIORATION DEGREE |
|---|---|---|---|---|---|---|---|---|
| | | | LOWEST (3) | LOWER (4) | NORMAL (5) | HIGHER (6) | HIGHEST (7) | |
| BLACK | WHITE | 12mm | 1 | 2 | 3 | 4 | 5 | 2 |
| BLACK | WHITE | 6mm | 2 | 3 | 4 | 5 | 6 | 1 |

752B (752)

| RIBBON COLOR | TAPE COLOR | RIBBON/ TAPE WIDTH | PRINT DATA | DENSITY DATA |
|---|---|---|---|---|
| BLACK | WHITE | 12mm | AAA | 3 |
| | | | BBB | 3 |
| BLACK | WHITE | 6mm | XXX | 4 |
| | | | YYY | 4 |

752C (752)

| RIBBON COLOR | TAPE COLOR | RIBBON/ TAPE WIDTH | PRINT DATA | DENSITY DATA |
|---|---|---|---|---|
| BLACK | WHITE | 12mm | AAA | 3 |
| | | | BBB | 3 |
| | | | PENCIL | 3 |
| | | | ERASER | 5 |
| | | | RULER | 5 |
| | | | SCISSORS | 5 |
| BLACK | WHITE | 6mm | XXX | 4 |
| | | | YYY | 4 |

FIG. 5

PRINTER, PRINTING SYSTEM INCLUDING THE SAME, AND COMPUTER-READABLE MEDIUM THEREFOR

CROSS-REFERENCE TO RELATED APPLICATION

This application claims priority under 35 U.S.C. § 119 from Japanese Patent Application No. 2017-087779 filed on Apr. 27, 2017. The entire subject matter of the application is incorporated herein by reference.

BACKGROUND

Technical Field

Aspects of the present disclosure are related to a printer, a printing system including the printer, and a non-transitory computer-readable medium therefor.

Related Art

A printer has been known that is configured to perform printing using a replaceable cassette housing a print medium and an ink ribbon. The known printer may store a table containing a plurality of pieces of individual information and a plurality of usage histories associated with each other. Each piece of individual information may contain a thickness of a tape in a tape cassette and an identifier for discriminating the tape cassette from other tape cassettes. Each usage history contains a plurality of printing histories and a remaining amount of the tape. The printer may control a display to display a first selection screen for selecting one of the plurality of pieces of individual information contained in the table. Further, in response to one of the plurality of pieces of individual information being selected on the first selection screen, the printer may control the display to display a second selection screen for selecting one of the plurality of printing histories contained in the usage history associated with the selected individual information. In response to one of the plurality of printing histories being selected, the printer may determine whether the printer is allowed to perform printing in accordance with the selected printing history, based on the remaining amount of the tape. When determining that the printer is allowed to perform printing according to the selected printing history, the printer may perform printing in accordance with the selected printing history.

SUMMARY

In a printing system including a plurality of the known printers, by using the aforementioned technology, each individual printer may print on the print medium an image (e.g., a character string) in common among the plurality of printers. However, the printing system has a problem that a printer of the system might not print the common image with the same density as when the common image is printed by another printer of the system.

Aspects of the present disclosure are advantageous to provide one or more improved techniques, for a printing system including a plurality of printers, which enable each printer of the system to print an image in common among the plurality of printers with the same density as when the common image is printed by any other printer of the system.

According to aspects of the present disclosure, a printer is provided, which includes a thermal head configured to, when heated, print a particular image on a print medium with a particular density, an attachment holder configured to hold a memory device detachably attached thereto, the memory device storing print data for identifying the particular image and density data for identifying the particular density, and a controller. The controller is configured to perform a first printing process to control the thermal head to print a first image on the print medium with a first density, after the first printing process, store first print data for identifying the first image and first density data for identifying the first density into a first memory device attached to the attachment holder, when a second memory device storing second print data and second density data is attached to the attachment holder, acquire the second print data and the second density data from the second memory device, the second print data and the second density data having been stored into the second memory device by another printer, and perform a second printing process to control the thermal head to print a second image on the print medium with a second density, the second image being identified based on the acquired second print data, the second density being identified based on the acquired second density data.

According to aspects of the present disclosure, further provided is a printing system including a first printer and a second printer. The first printer includes a first thermal head, a first attachment holder configured to hold a memory device detachably attached thereto, and a first controller configured to perform a first printing process to control the first thermal head to print a first image with a first density, and after the first printing process, store first print data for identifying the first image and first density data for identifying the first density into the memory device attached to the first attachment holder. The second printer includes a second thermal head, a second attachment holder configured to hold the memory device detachably attached thereto, and a second controller configured to, when the memory device storing the first print data and the first density data is attached to the second attachment holder, acquire the first print data and the first density data from the memory device, the first print data and the first density data having been stored into the memory device by the first printer, and perform a second printing process to control the second thermal head to print the first image with the first density, the first image being identified based on the acquired first print data, the first density being identified based on the acquired first density data.

According to aspects of the present disclosure, further provided is a non-transitory computer-readable medium storing computer-readable instructions that are executable by a processor coupled with a printer. The printer includes a thermal head configured to, when heated, print a particular image on a print medium with a particular density, and an attachment holder configured to hold a memory device detachably attached thereto, the memory device storing print data for identifying the particular image and density data for identifying the particular density. The instructions are configured to, when executed by the processor, cause the processor to perform a first printing process to control the thermal head to print a first image on the print medium with a first density, after the first printing process, store first print data for identifying the first image and first density data for identifying the first density into a first memory device attached to the attachment holder, when a second memory device storing second print data and second density data is attached to the attachment holder, acquire the second print data and the second density data from the second memory device, the second print data and the second density data having been stored into the second memory device by another printer, and perform a second printing process to control the thermal head to print a second image on the print medium with a second density, the second image being identified based on the acquired second print data, the second density being identified based on the acquired second density data.

BRIEF DESCRIPTION OF THE ACCOMPANYING DRAWINGS

FIG. 4 exemplifies tables stored in a printer and a table stored in a tape cassette attached to the printer, in the illustrative embodiment according to one or more aspects of the present disclosure.

FIG. 5 exemplifies tables stored in another printer and the table stored in the tape cassette attached to the said another printer, in the illustrative embodiment according to one or more aspects of the present disclosure.

Figure 6A:
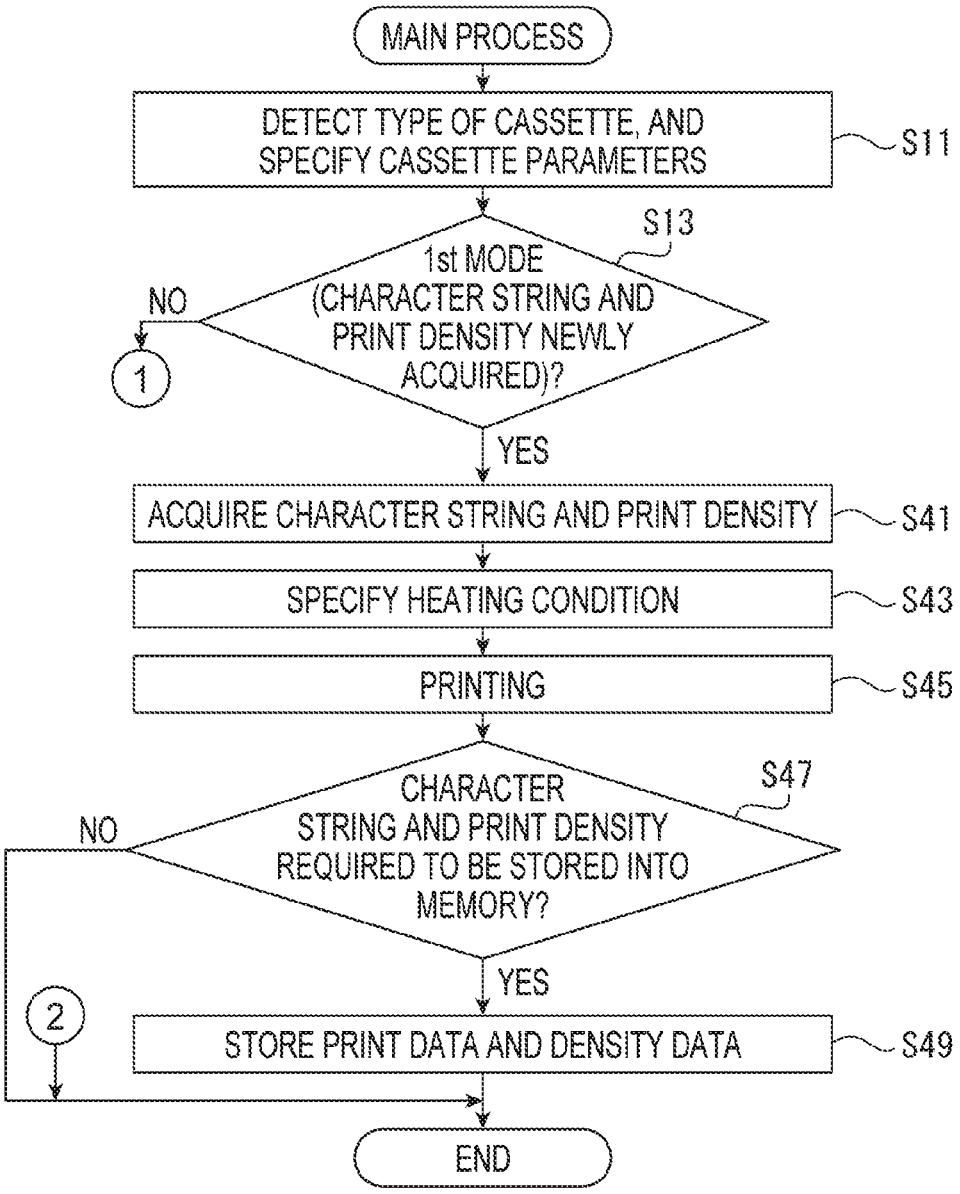
Figure 6B:
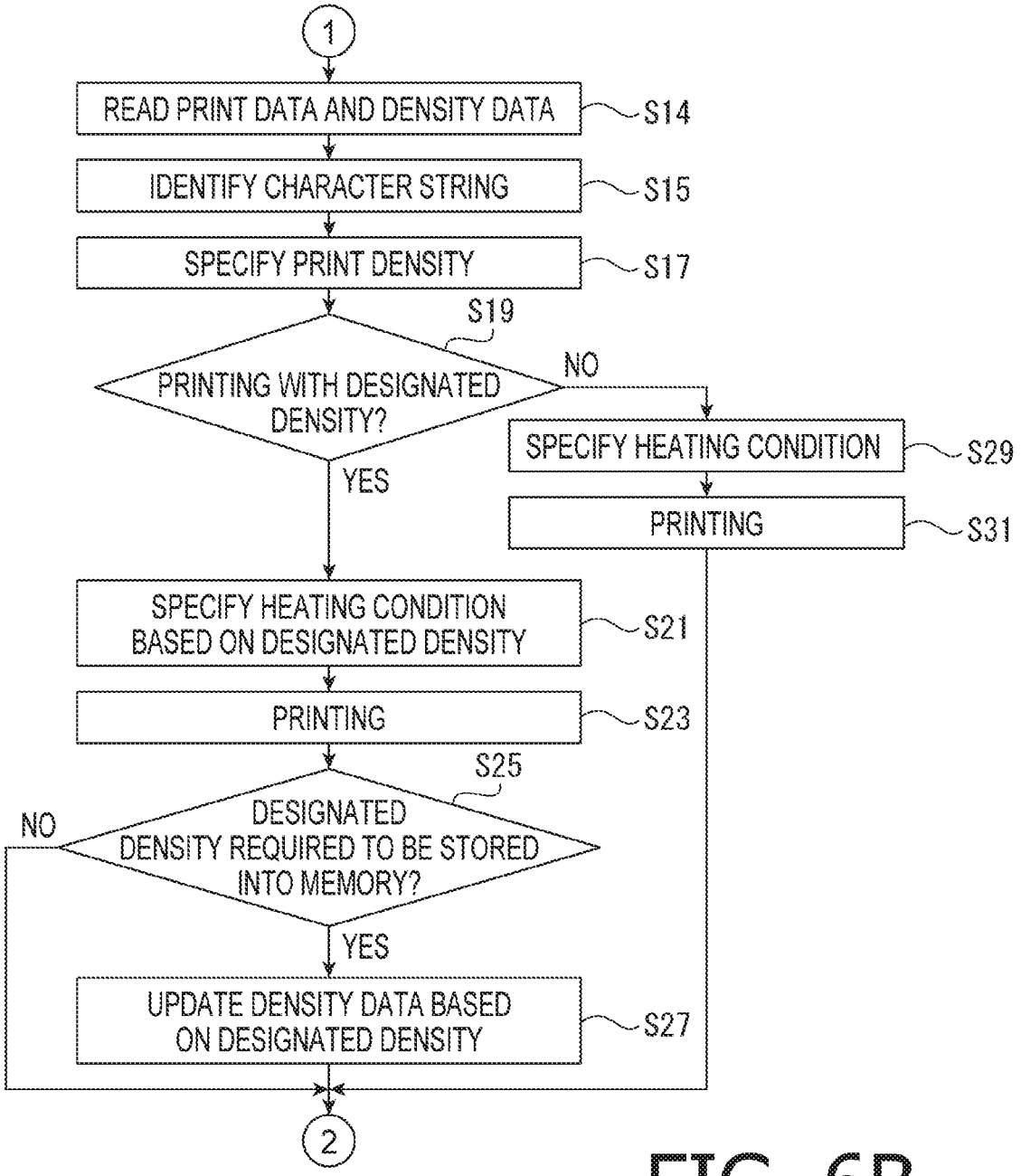

FIGS. 6A and 6B are flowcharts showing a procedure of a main process in the illustrative embodiment according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

<Overview of Printer>

Hereinafter, an illustrative embodiment according to aspects of the present disclosure will be described with reference to the accompanying drawings. A printer 1 is configured to print an image (e.g., characters, a character string, symbols, numeric characters, figures, and pictographs) on a tape 50 (see FIG. 2) as a print medium, thereby producing a label. In the illustrative embodiment, the following description will be provided under an assumption that a character string is printed as an image to be printed on the label. In the following description, a left side, a right side, a front side, a rear side, an upside, and a downside of the printer 1 may be defined as shown in FIG. 1.

Figure 1:
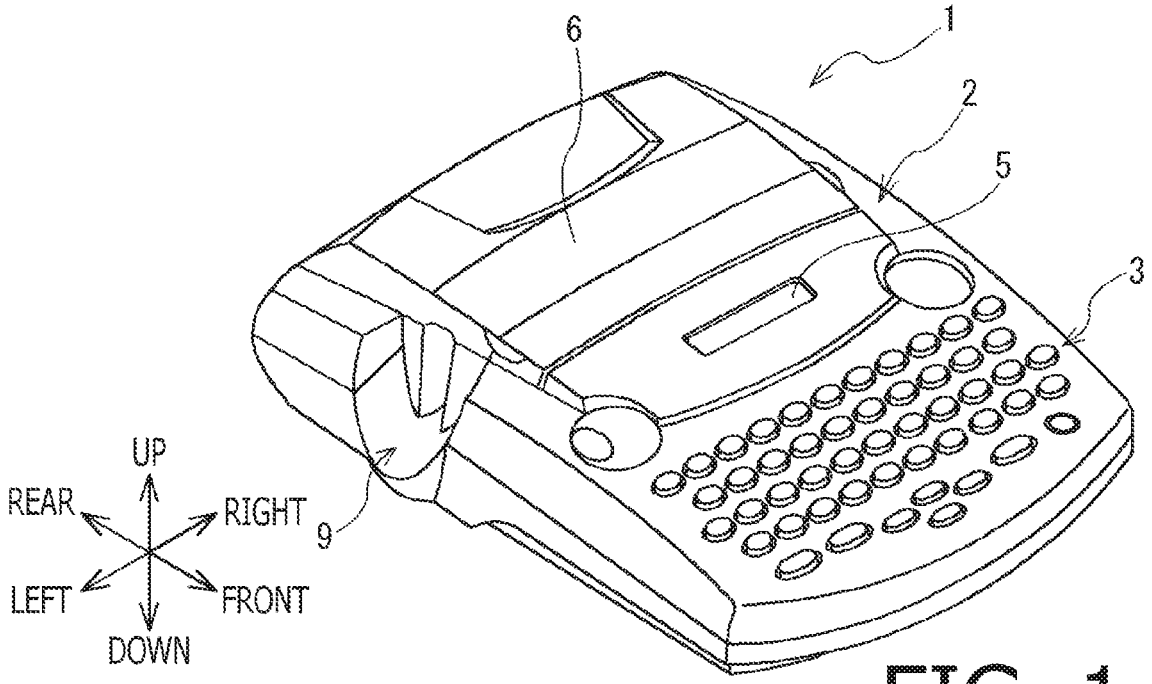
FIG. 1 is a perspective view schematically showing a printer in an illustrative embodiment according to one or more aspects of the present disclosure.

As shown in FIG. 1, the printer 1 includes a main body cover 2. The main body cover 2 is a housing formed in a rectangular parallelepiped shape. The printer 1 includes a keyboard 3 disposed on an upper front surface of the main body cover 2. A user may input a character string via the keyboard 3. The keyboard 3 includes a power switch, specific-purpose keys, and cursor keys. At the rear of the keyboard 3, a display 5 is disposed. The display 5 is configured to display various kinds of information. For instance, the display 5 may include a dot matrix LCD. Behind the display 5 (i.e., on a rear side of the display 5), a cassette cover 6 is disposed. The cassette cover 6 is openable and closable relative to the main body cover 2. At a left rear portion of the main body cover 2, a discharge port 9 is formed. Through the discharge port 9, a printed tape 50 is discharged out of the main body cover 2.

Figure 2:
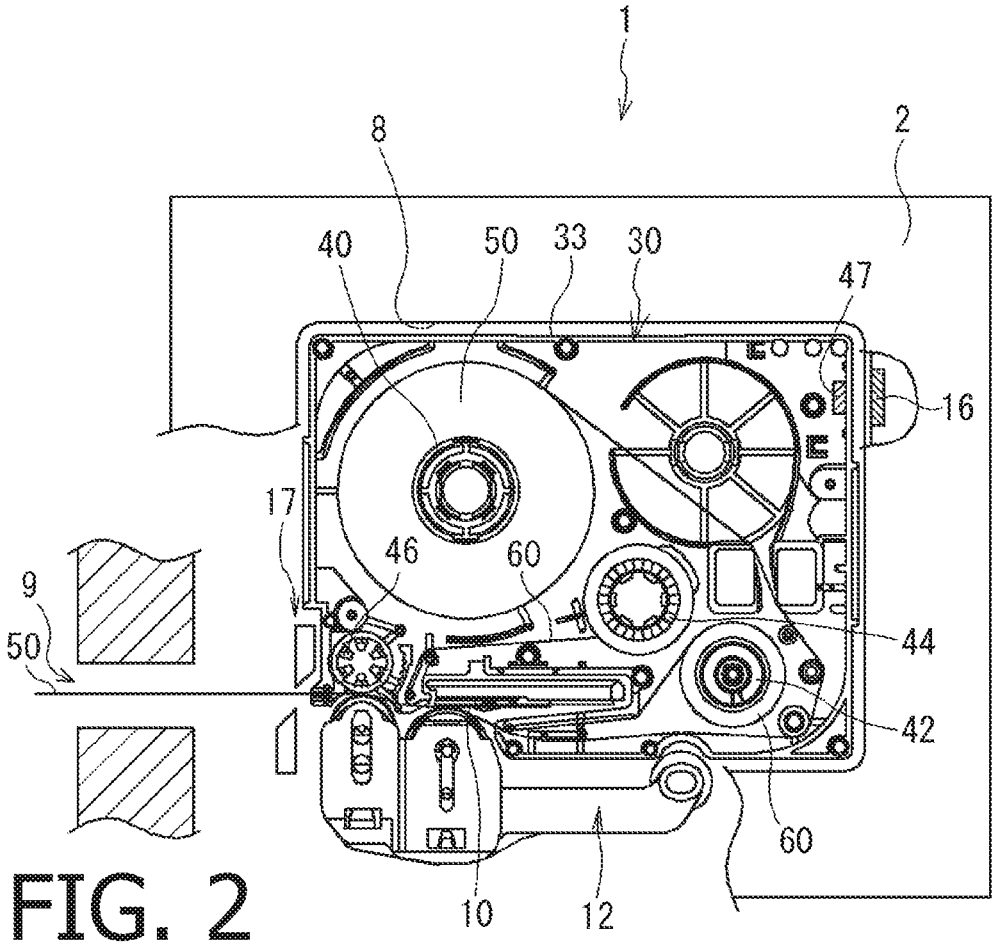
FIG. 2 is a cross-sectional plane view schematically showing an internal configuration of the printer in the illustrative embodiment according to one or more aspects of the present disclosure.

As shown in FIG. 2, an attachment compartment 8 is formed at a lower portion of the cassette cover 6 (see FIG. 1) inside the main body cover 2. The attachment compartment 8 is a recessed section formed to accommodate a tape cassette 30. In other words, the attachment compartment 8 is configured in such a manner that the tape cassette 30 is detachably attached thereto. In the following description, the tape cassette 30 that is attached into the attachment compartment 8 may be referred to as the "attached tape cassette 30." The printer 1 is configured to print a character string input via the keyboard 3, using the attached tape cassette 30.

The tape cassette 30 includes a box-shaped cassette case 33 configured to accommodate the tape 50 and an ink ribbon 60. A tape spool 40 around which the unprinted tape 50 is wound is rotatably supported at a left rear portion inside the cassette case 33. A ribbon spool 42 around which the unused ribbon 60 is wound is rotatably supported at a right front portion inside the cassette case 33. A width of the ink ribbon 60 is identical to a width of the tape 50. A ribbon winding spool 44 is rotatably supported between the tape spool 40 and the ribbon spool 42. The ribbon winding spool 44 is configured to pull the unused ink ribbon 60 out of the ribbon spool 42 and wind the ink ribbon 60 used for printing. A tape driving roller 46 is rotatably supported at a left front corner portion inside the cassette case 33. The tape driving roller 46 is configured to pull the unprinted tape 50 out of the tape spool 40.

An IC tag 47 is attached to the tape cassette 30. The IC tag 47 is disposed at a right rear corner portion inside the cassette case 33. The IC tag 47 includes a memory device 470 (see FIG. 3). The memory device 470 is configured to store a below-mentioned table 471 (see FIGS. 4 and 5).

In the attachment compartment 8, a ribbon winding shaft (not shown), tape driving shaft (not shown), a thermal head 10, a platen mechanism 12 and a data read/write device 16 are disposed. The ribbon winding shaft is inserted into the ribbon winding spool 44. The ribbon winding shaft is configured to rotate in response to receipt of a driving force from a tape feed motor 23 (see FIG. 3). The tape driving shaft is inserted into a tape driving roller 46. The tape driving shaft is configured to rotate in response to receipt of the driving force from the tape feed motor 23 via a transmission mechanism (not shown). The thermal head 10 is disposed at the right of the tape driving shaft. The printer 1 is configured to, by heating the thermal head 10, perform printing on the tape 50 with the unused ink ribbon 60. The platen mechanism 12 is configured to bring the tape 50 and the ink ribbon 60 into pressure contact with each other, between the thermal head 10 and the platen mechanism 12.

The data read/write device 16 is disposed at a right rear portion of the attachment compartment 8. The data read/write device 16 is opposed to the IC tag 47 of the attached tape cassette 30 across a right wall of the cassette case 33. The data read/write device 16 is configured to read data from and write data into the memory device 470 of the IC tag 47 of the attached tape cassette 30 in an RFID method ("RFID" is an abbreviation of "radio-frequency identification"). A cutting mechanism 17 is disposed near the discharge port 9. The cutting mechanism 17 is configured to cut the tape 50 in a particular position in response to receipt of a driving force from a cutting motor 24 (see FIG. 3).

The printer 1 may set one of five levels (e.g., "lowest," "lower," "normal," "higher," and "highest") as a print density for a printing process to heat the ink ribbon 60 by the thermal head 10 and perform printing on the tape 50. The printer 1 controls the print density by changing a heating condition for the thermal head 10 for each level of the print density. For instance, the heating condition may be an electric current value for supplying electricity to a plurality of heating elements included in the thermal head 10. For the sake of easy understanding, the five levels for the print density may be expressed as specific values. Specifically, the five different print densities may be expressed as "lowest: 3," "lower: 4," "normal: 5," "higher: 6," and "highest: 7."

<Electrical Configuration of Printer>

Figure 3:
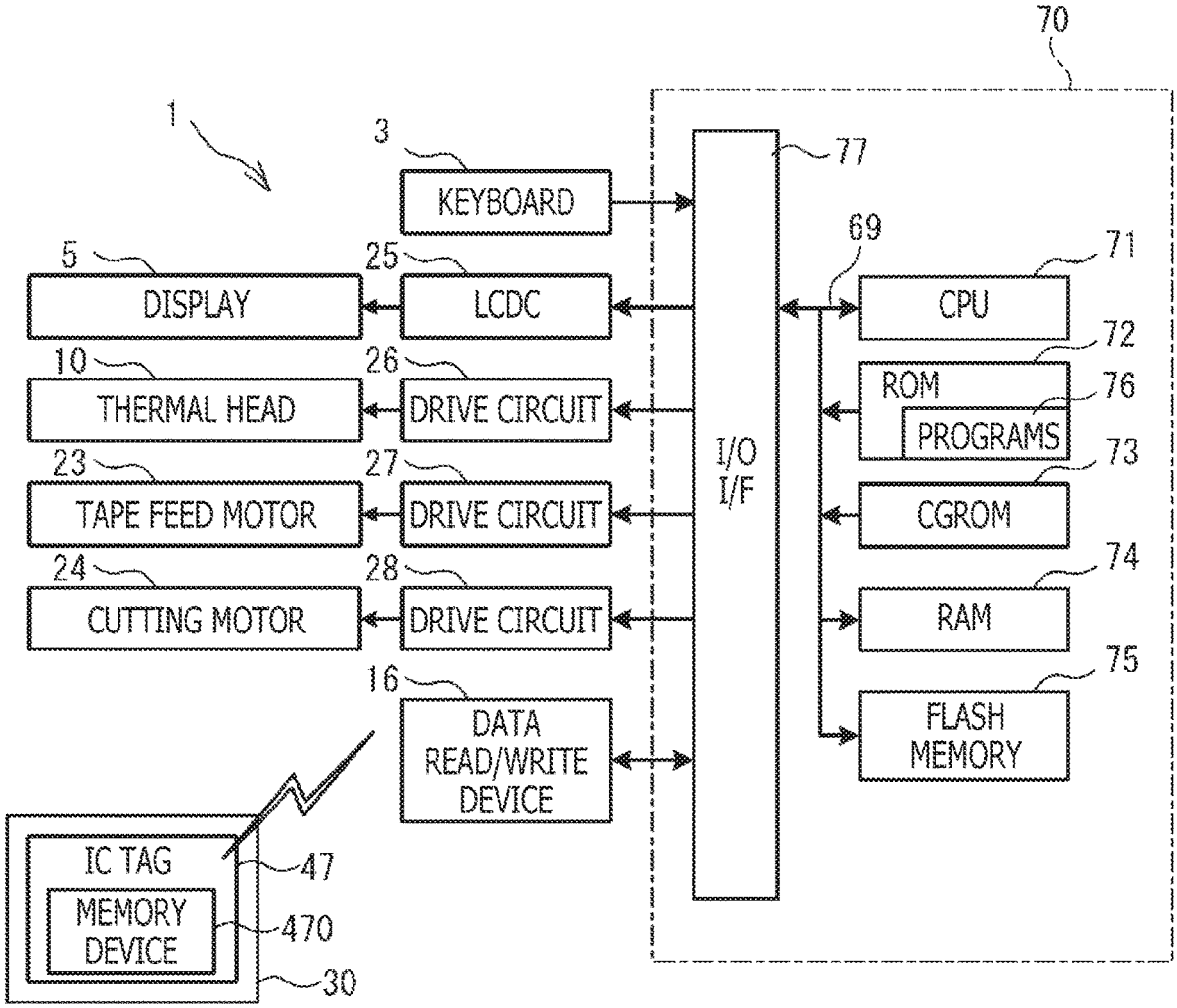
FIG. 3 is a block diagram showing an electrical configuration of the printer in the illustrative embodiment according to one or more aspects of the present disclosure.

An electrical configuration of the printer 1 will be described with reference to FIG. 3. The printer 1 includes a controller 70. The controller 70 includes a plurality of circuits. More specifically, the controller 70 includes a CPU 71, a ROM 72, a CGROM 73, a RAM 74, a flash memory 75, and an I/O I/F 77 ("I/O I/F" is an abbreviation of "input/output interface"). The aforementioned elements included in the controller 70 are interconnected via a data bus. The CPU 71 is configured to take overall control of the printer 1. The ROM 72 may store programs 76 to be executed by the CPU 71. Further, the ROM 72 may store various parameters for the CPU 71 to execute programs. In this regard, it is noted that the flash memory 76 may store the programs 76. The flash memory 76 may store below-mentioned tables 751 and 752 (see FIGS. 4 and 5). The CGROM 73 may store internal fonts. The RAM 74 has a plurality of storage areas such as a text memory and a print buffer.

The I/O I/F 77 is connected with the keyboard 3, an LCDC ("LCDC" is an abbreviation of "Liquid Crystal Drive Circuit") 25, drive circuits 26, 27, and 28, and the data read/write device 16. The LDCD 25 includes a video RAM (not shown) for transmitting display data to the display 5. The drive circuit 26 is configured to drive the thermal head 10. The drive circuit 27 is configured to drive the tape feed motor 23. The drive circuit 28 is configured to drive the cutting motor 24.

<Influences of Aged Deterioration>

The thermal head 10 of the printer 1 may deteriorate with time by repeatedly performing a printing process. In such a case, even when the thermal head 10 is heated under the same heating condition, it is more difficult to increase a temperature of the thermal head 10 that is more deteriorated by aging. Therefore, as the thermal head 10 becomes more deteriorated by aging, an amount of ink to be transferred from the ink ribbon 60 to the tape 50 becomes smaller. Accordingly, as the thermal head 10 becomes more deteriorated by aging, the print density of a character string to be printed on the tape 50 becomes lower.

Further, a degree of aged deterioration of the thermal head 10 may differ depending on colors of the ink ribbon 60 and the tape 50 housed in the tape cassette 30 and/or widths of the ink ribbon 60 and the tape 50. This is because the heating condition for the thermal head 10 may differ depending on the color of the ink ribbon 60 and/or the color of the tape 50, even in attempts to print the same character string. Further, because a heated area of the thermal head 10 in a printing process may differ depending on the widths of the ink ribbon 60 and the tape 50.

The printer 1 may identify a deterioration degree by performing test printing. The deterioration degree is a parameter representing a degree of aged deterioration of the thermal head 10. More specifically, first, the printer 1 performs a printing process to print a particular test character string with each of the five settable levels (i.e., "lowest," "lower," "normal," "higher," and "highest") of the print density. At this time, the printer 1 refers to an initial condition that is previously stored in the ROM 72 as a heating condition for the thermal head 10 for each individual level of the print density. After the printing process, the user identifies a print density of the test character string printed with each of the five levels of the print density.

When the test printing is performed by a printer 1 that is not deteriorated by aging, resulting print densities of the test character string printed with the five settable levels (i.e., "lowest," "lower," "normal," "higher," and "highest") of the print density are identified as "lowest: 3," "lower: 4," "normal: 5," "higher: 6," and "highest: 7," respectively. Hereinafter, these print densities of the test character string may be referred to as "standard densities." Meanwhile, when the test printing is performed by a printer 1 that is deteriorated by aging, a print density of the test character string printed with each of the five settable levels of the print density is lower than a corresponding one of the standard densities. Suppose for instance that, due to influences of the aged deterioration, print densities of the test character string printed with the five settable levels (i.e., "lowest," "lower," "normal," "higher," and "highest") of the print density are identified as "lowest: 2," "lower: 3," "normal: 4," "higher: 5," and "highest: 6," respectively. The user inputs the identified print densities into the printer 1. The printer 1 registers density data for identifying the input print densities, onto the table 751 stored in the flash memory 75.

FIG. 4 shows a table 751A stored in a flash memory 75 of a printer 1A. After execution of test printing by the printer 1A, resulting print densities ("lowest: 2," "lower: 3," "normal: 4," "higher: 5," and "highest: 6"), respectively corresponding to the five settable levels (i.e., "lowest," "lower," "normal," "higher," and "highest") of the print density, are registered on the table 751A. Density data for identifying the registered print densities is stored on the table 751A in association with respective colors (e.g., black and white) of an ink ribbon 60 and a tape 50 housed in a tape cassette 30 attached to an attachment compartment 8, and a width (e.g., 12 mm) of the ink ribbon 60 and the tape 50. Hereinafter, a combination of respective colors of the ink ribbon 60 and the tape 50 housed in the tape cassette 30 and a width of the ink ribbon 60 and the tape 50 may be referred to as "cassette parameters."

Further, the printer 1A subtracts the registered print densities from standard densities, thereby calculating a deterioration degree of "1." Each of the standard densities is shown within a parenthesis for a corresponding one of the five settable levels of the print density. The calculated deterioration degree of "1" is stored in association with the cassette parameters and the density data. As a degree of aged deterioration according to repeated uses of the printer 1A becomes higher, the deterioration degree becomes a larger value. Namely, the deterioration degree may be a parameter representing a degree of aged deterioration based on a usage state (e.g., a usage frequency) of the printer 1.

Each time test printing is performed after a different tape cassette 30 is attached, new density data and a new deterioration degree are stored onto the table 751. Therefore, the table 751A shown in FIG. 4 stores density data and a deterioration degree associated with cassette parameters ("the color of the ink ribbon 60: black," "the color of the tape 50: white," and "the width of the ink ribbon 60 and the tape 50: 6 mm"), as well as the density data and the deterioration degree associated with the cassette parameters ("the color of the ink ribbon 60: black," "the color of the tape 50: white," and "the width of the ink ribbon 60 and the tape 50: 12 mm").

<Overview of Printing Process in First Mode>

A case in which a print instruction specifying a character string and a print density level is input via the keyboard 3 of the printer 1 will be exemplified. In this case, the printer 1 stores, onto the table 752, print data for identifying the input character string, and density data for identifying the input print density level. FIG. 4 shows a table 752A stored in the flash memory 75 of the printer 1A. When a print instruction specifying a character string "ERASER" and a print density level "normal" is input via the keyboard 3 of the printer 1A, the printer 1A stores, onto the table 752A, print data for identifying the character string "ERASER" and density data for identifying the print density level "normal" in association with the cassette parameters ("the color of the ink ribbon 60: black," "the color of the tape 50: white," and "the width of the ink ribbon 60 and the tape 50: 12 mm").

Each time a print instruction specifying a character string and a print density is input, new print data and new density data are stored onto the table 752. Therefore, the table 752A shown in FIG. 4 stores, as well as a combination of "ERASER" and "5," a combination of "PENCIL" and "3," a combination of "RULER" and "5," and a combination of "SCISSORS" and "5" as combinations of print data and density data associated with the cassette parameters ("the color of the ink ribbon 60: black," "the color of the tape 50: white," and "the width of the ink ribbon 60 and the tape 50: 12 mm"). Further, the table 752A stores a combination of "CCC" and "4" and a combination of "DDD" and "4" as combinations of print data and density data associated with the cassette parameters ("the color of the ink ribbon 60: black," "the color of the tape 50: white," and "the width of the ink ribbon 60 and the tape 50: 6 mm").

When print data for identifying the input character string is already stored on the table 752 in association with the same cassette parameters as the cassette parameters for the tape cassette 30 attached to the attachment compartment 8, density data stored in association with the print data may be overwritten and updated with density data for identifying the input print density. Alternatively, the user may make a selection as to whether to overwrite and update the density data stored on the table 752 with the density data for identifying the input print density. In any case, the table 752 stores print data and density data in association with each combination of cassette parameters.

A case where the printer 1A performs a printing process in response to an input print instruction will be exemplified. In this case, even when the printer 1A heats the thermal head 10 under an initial condition that is associated with an input print density level "normal" among the initial conditions stored in the ROM 72, the temperature of the thermal head 10 does not sufficiently increase due to influences of the aged deterioration. Therefore, a resulting print density of a printed character string is lower than the standard density "5" for the print density level "normal."

To address such a problem, in the illustrative embodiment, the printer 1A specifies a heating condition for the thermal head 10 to perform printing with a print density level "higher," which is identified by a modified density "6" obtained by adding a deterioration degree "1" to the standard density "5" of the input print density level "normal." The printer 1A heats the thermal head 10 under the specified heating condition. Thereby, the character string is printed on the tape 50 with the standard density "5." Namely, referring to the density data stored on the table 751A, the printer 1A may directly identify the standard density "5" of the print density level "normal." At the same time, to specify the heating condition for the thermal head 10, referring to the density data stored on the table 751A, the printer 1A may indirectly identify the intended print density "6" of the print density level "higher" based on the deterioration degree "1." An operation mode in which a printing process is performed based on a character string and a print density specified via the keyboard 3 in the aforementioned manner may be referred to as a "first mode."

After performing the printing process in response to the print instruction, the printer 1A extracts print data and density data associated with the cassette parameters of the tape cassette 30 attached to the attachment compartment 8 from among the print data and the density data stored on the table 752A. The printer 1A stores the extracted print data and density data onto the table 471 in the memory device 470 of the tape cassette 30 attached to the attachment compartment 8, via the data read/write device 16.

In the example shown in FIG. 4, the table 752A stores the combination of "PENCIL" and "3," the combination of "ERASER" and "5," the combination of "RULER" and "5," and the combination of "SCISSORS" and "5" as combinations of print data and density data associated with the cassette parameters ("the color of the ink ribbon 60: black," "the color of the tape 50: white," and "the width of the ink ribbon 60 and the tape 50: 12 mm") of the attached tape cassette 30. Therefore, the printer 1A extracts the combination of "PENCIL" and "3," the combination of "ERASER" and "5," the combination of "RULER" and "5," and the combination of "SCISSORS" and "5," and stores the extracted combinations of print data and density data onto the table 471 of the tape cassette 30.

<Overview of Printing Process in Second Mode>

A case in which the tape cassette 30 used in the printing process by the printer 1A is attached to an attachment compartment 8 of a printer 1B (see FIG. 5) different from the printer 1A will be exemplified. As a specific example of the case, there may be a case where in the middle of a particular operation to repeatedly print a character string by the printer 1A, the user switches the printer 1 in use from the printer 1A to the printer 1B and resumes the particular operation by the printer 1B. In this case, it is preferred that a print density of the character string printed by the printer 1A is identical to a print density of the character string to be printed by the printer 1B.

As shown in FIG. 5, the tape cassette 30, of which the print data and the density data are stored on the table 47 by the printer 1A (see FIG. 4), is detached from the printer 1A and then attached to the attachment compartment of the printer 1B. At this time, it is assumed that tables 751B and 752B are already stored in a flash memory 75 of the printer 1B. In this case, the printer 1B reads out the print data and the density data stored on the table 471 in the memory device 470 of the tape cassette 30 via a data read/write device 16. The printer 1B stores the read print data and density data onto the table 752B in association with the cassette parameters ("the color of the ink ribbon 60: black," "the color of the tape 50: white," and "the width of the ink ribbon 60 and the tape 50: 12 mm") of the attached tape cassette 30. Consequently, the table 752B is changed to a table 752C. In FIG. 5, the print data and the density data added in the aforementioned manner are shown as surrounded by a thick frame on the table 752C.

The printer 1B extracts, from the table 752C, print data associated with the cassette parameters of the tape cassette 30 attached to the attachment compartment 8. The printer 1B displays, on the display 5, character strings "AAA," "BBB," "PENCIL," "ERASER," "RULER," and "SCISSORS" specified by the extracted print data. Suppose for instance that the user selects the character string "ERASER," which is the same as the character string printed by the printer 1A, from among the displayed character strings.

The printer 1B performs a printing process to print the selected character string "ERASER" in the following manner. The printer 1B extracts, from the table 752C, the density data "5" associated with the print data of the selected character string "ERASER." Even when the printer 1B heats the thermal head 10 under the initial condition corresponding to the print density level "normal" among the initial conditions stored in the ROM 72, the temperature of the thermal head 10 does not sufficiently increase due to influences of the aged deterioration. Hence, a print density of the printed character string is lower than the standard density "5" for the print density level "normal."

To address such a problem, in the illustrative embodiment, the printer 1B extracts, from the table 752C, a deterioration degree "2" associated with the cassette parameters ("the color of the ink ribbon 60: black," "the color of the tape 50: white," and "the width of the ink ribbon 60 and the tape 50: 12 mm") of the tape cassette 30 attached to the attachment compartment 8. The printer 1B specifies a heating condition for the thermal head 10 to perform printing with a print density level "highest," which is identified by a modified density "7" obtained by adding the extracted deterioration degree "2" to the standard density "5" of the input print density level "normal." Namely, referring to the density data stored on the table 752C, the printer 1B may directly identify the standard density "5" of the print density level "normal" for the character string to be printed. At the same time, to specify the heating condition for the thermal head 10, referring to the density data stored on the table 752C, the printer 1A may indirectly identify the intended print density "7" of the print density level "highest" based on the deterioration degree "2." The printer 1B heats the thermal head 10 under the specified heating condition. Thereby, the character string "ERASER" is printed on the tape 50 with the standard density "5." Thus, the printer 1B may print the character string "ERASER" on the tape 50 with the same print density as the print density for the printing process to print the character string "ERASER" by the printer 1A. An operation mode in which a printing process is performed based on a character string and a print density level stored on the table 752 in the aforementioned manner may be referred to as a "second mode."

<Main Process>

A main process will be described with reference to FIGS. 6A and 6B. In response to receipt of a print instruction input via the keyboard 3, the CPU 71 starts the main process by executing one or more programs 76 stored in the ROM 72. It is noted that the one or more programs 76 may be stored in the flash memory 75. The CPU 71 detects a type of the tape cassette 30 attached to the attachment compartment 8 (S11). Based on the detected type of the tape cassette 30, the CPU 71 specifies cassette parameters (the color of the ink ribbon 60, the color of the tape 50, the width of the ink ribbon 60 and the tape 50) of the tape cassette 30 (S11).

The CPU 71 detects an operation to select one of the first mode and the second mode, via the keyboard 3. When detecting an operation to select the first mode (S13: Yes), the CPU 71 goes to S41. When detecting an operation to select the second mode (S13: No), the CPU 71 goes to S14.

When the first mode is selected (S13: Yes), an operation to input a character string and a print density is performed via the keyboard 3. The CPU 71 acquires the input character string and the input print density (e.g., one of the print density "3" of the print density level "lowest," the print density "4" of the print density level "lower," the print density "5" of the print density level "normal," the print density "6" of the print density level "higher," and the print density "7" of the print density level "highest") (S41). The CPU 71 acquires, from the table 751 (see FIGS. 4 and 5), a deterioration degree associated with the cassette parameters specified in S11. The CPU 71 calculates a modified density by adding the deterioration degree to the input print density. The CPU 71 specifies a heating condition for the thermal head 10 to perform printing with the same print density as the modified density (S43). The CPU 71 heats the thermal head 10 under the specified heating condition. Thereby, the CPU 71 heats the ink ribbon 60 by the thermal head 10 and prints the input character string on the tape 50 (S45). Afterwards, the CPU 71 goes to S47.

The CPU 71 controls the display 5 to display an inquiry screen for inquiring of the user whether to store the character string and the print density acquired in S41 into the printer 1 and the tape cassette 30. In response to an instruction to store the character string and the print density being input via the keyboard 3 (S47: Yes), the CPU 71 goes to S49. On the table 752 (see FIGS. 4 and 5), the CPU 71 stores the cassette parameters specified in S11, in association with print data for identifying the character string acquired in S41 and density data for identifying the print density acquired in S41 (S49). Further, the CPU 71 extracts, from the table 752, print data and density data associated with the cassette parameters specified in S11. The CPU 71 stores the extracted print data and the extracted density data onto the table 471 in the memory device 470 of the tape cassette 30 attached to the attachment compartment 8, via the data read/write device 16 (S49). The CPU 71 terminates the main process. Meanwhile, in response to an instruction not to store the character string or the print density being input via the keyboard 3 (S47: No), the CPU 71 terminates the main process.

Meanwhile, when the second mode is selected (S13: No), the CPU 71 reads out the print data and the density data stored on the table 471 in the memory device 470 of the tape cassette 30, via the data read/write device 16 (S14). The CPU 71 controls the display 5 to display character strings identified by the read print data. Further, the CPU 71 extracts, from the table 752, print data and density data associated with the cassette parameters specified in S11. The CPU 71 controls the display 5 to display character strings identified by the extracted print data.

The CPU 71 detects an operation to select one of the character strings displayed on the display 5, via the keyboard 3. The CPU 71 identifies the selected character string (S15). The CPU 71 specifies a print density associated with the identified character string with reference to the tables 471 and 752 (S17). More specifically, when a character string, identified by print data stored on the table 471 in the memory device 470 of the tape cassette 30, is selected, the CPU 71 specifies a print density based on density data associated with print data for identifying the selected character string among the print data stored on the table 471. Meanwhile, when a character string, identified by print data stored on the table 752, is selected, the CPU 71 specifies a print density based on density data associated with print data for identifying the selected character string among the print data stored on the table 752.

The CPU 71 determines whether an operation to input a designated density has been detected via the keyboard 3. The user inputs the designated density to newly designate a print density. When determining that an operation to input a designated density has not been detected via the keyboard 3, the CPU 71 determines not to cause the printer 1 to perform printing with the designated density (S19: No). In this case, the CPU 71 goes to S29. The CPU 71 acquires, from the table 751, a deterioration degree associated with the cassette parameter specified in S11. The CPU 71 calculates a modified density by adding the acquired deterioration degree to the print density specified in S17. The CPU 71 specifies a heating condition for the thermal head 10 to perform printing with the same print density as the modified density (S29). The CPU 71 heats the thermal head 10 under the specified heating condition. Thereby, the CPU 71 heats the ink ribbon 60 by the thermal head 10 and prints on the tape 50 the character string identified in S15 (S31). Afterwards, the CPU 71 terminates the main process.

When determining that an operation to input a designated density has been detected via the keyboard 3, the CPU 71 determines to cause the printer 1 to perform printing with the designated density (S19: Yes). In this case, the CPU 71 acquires, from the table 751, a deterioration degree associated with the cassette parameters specified in S11. The CPU 71 calculates a modified density by adding the acquired deterioration degree to the input designated density. The CPU 71 specifies a heating condition for the thermal head 10 to perform printing with the same print density as the calculated modified density (S21). The CPU 71 heats the thermal head 10 under the specified heating condition. Thereby, the CPU 71 heats the ink ribbon 60 by the thermal head 10 and prints on the tape 50 the character string identified in S15 (S23). Afterwards, the CPU 71 goes to S25.

The CPU 71 controls the display 5 to display an inquiry screen for inquiring of the user whether to store the input designated density into the printer 1 and the tape cassette 30. In response to an instruction to store the designated density being input via the keyboard 3 (S25: Yes), the CPU 71 goes to S27. On the table 752, the CPU 71 changes and updates density data for identifying the print density specified in S17 to density data for identifying the designated density (S27). Further, the CPU 71 extracts, from the table 752, print data and density data associated with the cassette parameters specified in S11. The CPU 71 stores the extracted print data and the extracted density data onto the table 471 in the memory device 470 of the tape cassette 30 attached to the attachment compartment 8 (S27). The CPU 71 terminates the main process. Meanwhile, when an instruction not to store the designated density is input via the keyboard 3 (S25: No), the CPU 71 terminates the main process.

<Operations and Advantageous Effects of Illustrative Embodiment>

The printer 1 has the attachment compartment 8 to which the tape cassette 30 is detachably attached. The tape cassette 30 includes the memory device 470 storing the table 471. On the table 471, print data and density data are stored in association with each other. When performing a printing process (S45), the printer 1 stores print data and density data onto the table 471 in the memory device 470 of the tape cassette 30 (S49). The printer 1 reads print data and density data out of the table 471 of the tape cassette 30 (S14), when the tape cassette 30 is attached to the attachment compartment 8 of the printer 1 after the print data and the density data have been stored onto the table 471 of the tape cassette 30 by another printer 1. The printer 1 identifies a character string selected by the user (S15), and specifies a print density associated with the identified character string (S17). The printer 1 prints the identified character string on the tape 50 with the specified print density (S23). In this case, the printer 1 may print a character string on the tape 50 with the same print density as when the character string is printed by the said another printer 1.

When respective usage states of a plurality of printers 1 are different from each other, respective degrees of aged deterioration of the plurality of printers 1 are different from each other. Therefore, even when each of the plurality of printers 1 heats the thermal head 10 under the same heating condition, respective print densities of a character string printed by the plurality of printers 1 may be different from each other. In order to address such a problem, in the illustrative embodiment, the printer 1 specifies a heating condition for the thermal head 10 based on a print density and a deterioration degree associated with specified cassette parameters with reference to the table 471 in the memory device 470 of the tape cassette 30 (S21). The printer 1 heats the thermal head 10 under the specified heating condition, and prints a character string on the tape 50 (S23). Thereby, the plurality of printers 1 may print the same character string on the tape 50 with the same print density.

The printer 1 stores, on the table 751, a deterioration degree in association with each combination of cassette parameters. Each combination of cassette parameters includes respective colors of the ink ribbon 60 and the tape 50 housed in the tape cassette 30, and a width of the ink ribbon 60 and the tape 50. In this case, even though the usage state of the thermal head 10 differs depending on each combination of cassette parameters, the printer 1 may adjust the heating condition for the thermal head 10 in accordance with each combination of cassette parameters. Thereby, even though the usage state of the thermal head 10 differs depending on each combination of cassette parameters of the attached tape cassette 30, the printer 1 may print a character string on the tape 50 with the same print density as when the character string is printed by another printer 1.

When an instruction to store a character string and a print density is input via the keyboard 3 (S47: Yes), the printer 1 stores, onto the table 752, print data for identifying the input character string and density data for identifying the input print density (S49). In this case, the user may flexibly determine whether to store the print data and the density data into the memory device 470 of the tape cassette 30. Hence, for instance, the user may store the print data and the density data into the memory device 470 of the tape cassette 30, only when the user has an intension to print the same character string by another printer 1.

The tape cassette 30 attached to the printer 1 includes the ink ribbon 60 and the tape 50. Therefore, when the tape cassette 30 is attached to the attachment compartment 8, the printer 1 may heat the ink ribbon 60 by the thermal head 10 and perform printing on the tape 50. Further, the tape cassette 30 includes the memory device 470. Hence, when the tape cassette 30 is attached to another printer 1, the said another printer 1 may print a character string on the tape 50 with the same print density as when the character string is printed by the printer 1.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

<Modifications>

An image to be printed by the printer 1 is not limited to a character string, but may be one or more numeric characters, one or more patterns, one or more symbols, or a barcode. When an image to be printed by the printer 1 is a character string, print data for identifying the character string may be raster data, JIS codes, or ASCII codes. Further, when an image to be printed by the printer 1 is one or more symbols or a barcode, print data for identifying the one or more symbols or the barcode may be multi-digit number (i.e., numerals in a plurality of digits) containing a country number, a maker number, a product number, and a check digit. The table 471 may not be stored in the memory device 470 of the IC tag 47 of the tape cassette 30. For instance, the table 471 may be stored in a storage medium (e.g., a USB memory or an SD card) attachable to the printer 1. In this case, the printer 1 may have, as an attachment compartment, a socket to which the storage medium is attachable. In the aforementioned illustrative embodiment, it is assumed that the thermal head 10 is deteriorated by aging. Nonetheless, in the printer 1, what is influenced by aged deterioration may not necessarily be limited to the thermal head 10. The number of the print density levels settable for the printer 1 is not limited to 5. For instance, the number of the print density levels settable for the printer 1 may be any of 1 to 4.

In the aforementioned illustrative embodiment, through execution of the test printing, the printer 1 acquires various kinds of information (e.g., density data and a deterioration degree) and stores the information onto the table 751. In this regard, the printer 1 may have a sensor configured to measure a print density of a character string printed in the test printing. Based on the measured print density, the printer 1 may store the density data onto the table 751. Further, the printer 1 may calculate various kinds of information to be stored on the table 751, based on an elapsed period of time since the start of the use of the printer 1, a total number of printed sheets, and a total length of the ink ribbon 60 or the tape 50 used for printing.

In the aforementioned illustrative embodiment, the printer 1 calculates a modified density by adding a deterioration degree to a print density identified by density data. The printer 1 specifies a heating condition for the thermal head 10 to perform printing with the calculated modified density (S29, S43). The deterioration degree is a parameter representing a degree of aged deterioration based on a usage state (e.g., a usage frequency) of the printer 1. Nonetheless, the printer 1 may store, on the table 751, a type parameter (e.g., a model and a type) representing a type of the printer 1, instead of the deterioration degree. The printer 1 may specify a heating condition for the thermal head 10 by making a calculation based on the print density and the type parameter. Further, the printer 1 may store both the deterioration degree and the type parameter on the table 751. The printer 1 may specify a heating condition for the thermal head 10 by making a calculation based on the print density, the deterioration degree, and the type parameter.

In the aforementioned illustrative embodiment, the deterioration degree is stored on the table 751 in association with each combination of cassette parameters. Nonetheless, instead of storing the deterioration degree in association with each combination of cassette parameters, the printer 1 may manage a deterioration degree in common among a plurality of combinations of cassette parameters. Namely, the printer 1 may store a single deterioration degree on the table 751. The printer 1 may specify a heating condition for the thermal head 10 based on the single deterioration degree, regardless of cassette parameters of the tape cassette 30 attached to the printer 1.

In the aforementioned illustrative embodiment, after printing the input character string on the tape 50 (S45), when an instruction to store the character string and the print density is input via the keyboard 3 (S47: Yes), the printer 1 stores onto the table 751 the character string and the print density in association with each other (S49). Nonetheless, whenever printing the input character string on the tape 50 (S45), the printer 1 may store onto the table 751 the character string and the print density in association with each other, regardless of whether the printer 1 receives an instruction to store the character string and the print density. The same may apply to a case where the printer 1 prints the character string on the tape 50 in S23.

The tape cassette 30 may not necessarily store the tape 50. In this case, for instance, a tape roll with the tape 50 wound therearound may be directly housed in the printer 1. Meanwhile, the tape cassette 30 may not necessarily house the ink ribbon 60. In this case, for instance, the tape cassette 30 may house a thermosensitive tape 50. The printer 1 may cause the thermal head 10 to directly heat the thermosensitive tape 50, thereby performing printing on the tape 50.

The printer 1 may specify a deterioration degree for each of a plurality of sections of the thermal head 10 divided in a width direction (i.e., a direction perpendicular to a conveyance direction for the ink ribbon 60), and may store each specified deterioration degree onto the table 751. Specifically, for instance, the printer 1 may specify a deterioration degree for each of three sections of the thermal head 10 divided in the width direction. Further, for instance, the printer 1 may store, onto the table 751B, the specified three deterioration degrees (e.g., 2, 1, and 3) with respect to the three sections of the thermal head 10 in the width direction, respectively, as deterioration degrees associated with the cassette parameters ("the color of the ink ribbon 60: black," "the color of the tape 50: white," and "the width of the ink ribbon 60 and the tape 50: 12 mm"). Further, before the printer 1B performs a printing process, the printer 1B may specify a heating condition for each of the three sections of the thermal head 10 thereof, based on the three deterioration degrees. In this case, even when respective degrees of aged deterioration of the three sections of the thermal head 10 are different from each other, the printer 1B may adjust the heating condition for each section of the thermal head 10. Thereby, even when respective degrees of aged deterioration of the three sections of the thermal head 10 are different from each other, the printer 1B may print a character string on the tape 50 with the same print density as when the character string is printed by another printer 1.

In the main process shown in FIGS. 6A and 6B, for instance, the CPU 71 of the printer 1A may execute S11, S13, and S41 to S49, and the CPU 71 of the printer 1B may executed S11, S13, and S14 to S31.

Namely, the CPU 71 (hereinafter referred to as the "CPU 71A") of the printer 1A may acquire a character string and a print density input via the keyboard 3 (S41), and may specify a heating condition for the thermal head 10 based on the print density and a deterioration degree (S43). The CPU 71A may heat the thermal head 10 under the specified heating condition, thereby printing the input character string on the tape 50 (S45). The CPU 71A may store print data (hereinafter referred to as "first print data") for identifying the input character string and density data (hereinafter referred to as "first density data") for identifying the input print density, into the memory device 470 of the tape cassette 30 attached to the attachment compartment 8 (S49). The tape cassette 30 may be detached from the attachment compartment 8 of the printer 1A, and then, may be attached to the attachment compartment 8 of the printer 1B.

Further, the CPU 71 (hereinafter referred to as the "CPU 71B") of the printer 1B may read the first print data and the first density data out of the memory device 470 of the tape cassette 30 attached to the attachment compartment 8 of the printer 1B (S14). The CPU 71B may specify a heating condition for the thermal head 10 of the printer 1B, based on a print density identified by the first density data and a deterioration degree (S29). The CPU 71B may heat the thermal head 10 under the specified heating condition, thereby printing on the tape 50 a character string identified by the first print data (S31).

Associations between elements exemplified in the aforementioned illustrative embodiment and elements according to aspects of the present disclosure will be exemplified below. The printer 1 may be an example of a "printer" according to aspects of the present disclosure. The thermal head 10 may be an example of a "thermal head" according to aspects of the present disclosure. The attachment compartment 8 may be an example of an "attachment holder" according to aspects of the present disclosure. The memory device 470 included in the tape cassette 30 may be an example of a "memory device" according to aspects of the present disclosure. The controller 70 may be an example of a "controller" according to aspects of the present disclosure. The CPU 71 and the ROM 72 (or the flash memory 75) storing the programs 76 may be included in the "controller" according to aspects of the present disclosure.

What is claimed is:

1. A printer comprising:

a thermal head configured to, when heated, print a particular image on a print medium with a particular density;

an attachment holder configured to hold a memory device detachably attached thereto, the memory device storing print data for identifying the particular image and density data for identifying the particular density; and a controller configured to:

perform a first printing process to control the thermal head to print a first image on the print medium with a first density;

after the first printing process, store first print data for identifying the first image and first density data for identifying the first density into a first memory device attached to the attachment holder;

when a second memory device storing second print data and second density data is attached to the attachment holder, acquire the second print data and the second density data from the second memory device, the second print data and the second density data having been stored into the second memory device by another printer; and perform a second printing process to control the thermal head to print a second image on the print medium with a second density, the second image being identified based on the acquired second print data, the second density being identified based on the acquired second density data.

2. The printer according to claim 1, wherein the controller is further configured to:

specify a first heating condition for the thermal head to print the first image with the first density, based on a parameter representing at least one of a usage state and a type of the printer;

heat the thermal head under the specified first heating condition, thereby performing the first printing process;

specify a second heating condition for the thermal head to print the second image with the second density, based on the acquired second density data and the parameter;

heat the thermal head under the specified second heating condition, thereby performing the second printing process.

3. The printer according to claim 2, wherein the parameter represents the usage state of the printer for each of a plurality of sections of the thermal head.

4. The printer according to claim 2, wherein the controller is further configured to:

heat an ink ribbon by the thermal head heated under the first heating condition, thereby performing the first printing process; and heat the ink ribbon by the thermal head heated under the second heating condition, thereby performing the second printing process, and wherein the parameter represents the usage state of the printer associated with a specific width of the ink ribbon.

5. The printer according to claim 1, wherein the controller is further configured to, in response to receipt of an instruction to store the first print data and the first density data, store the first print data and the first density data into the first memory device attached to the attachment holder.

6. The printer according to claim 1, wherein the memory device is included in a cassette housing an ink ribbon, wherein the attachment holder is further configured to hold the cassette detachably attached thereto, and wherein the controller is further configured to control the thermal head to heat the ink ribbon housed in the cassette attached to the attachment holder, thereby performing the first printing process and the second printing process.

7. The printer according to claim 1, wherein the memory device is included in a cassette housing the print medium, wherein the attachment holder is further configured to hold the cassette detachably attached thereto, and wherein the controller is further configured to:

perform the first printing process to control the thermal head to print the first image on the print medium housed in the cassette attached to the attachment holder, with the first density; and perform the second printing process to control the thermal head to print the second image on the print medium housed in the cassette attached to the attachment holder, with the second density.

8. The printer according to claim 1, wherein the controller comprises:

a processor; and a memory storing processor-executable instructions configured to, when executed by the processor, cause the processor to:

perform the first printing process;

after the first printing process, store the first print data and the first density data into the first memory device attached to the attachment holder;

when the second memory device storing the second print data and the second density data is attached to the attachment holder, acquire the second print data and the second density data from the second memory device; and perform the second printing process.

9. A non-transitory computer-readable medium storing computer-readable instructions that are executable by a processor coupled with a printer, the printer comprising:

a thermal head configured to, when heated, print a particular image on a print medium with a particular density; and an attachment holder configured to hold a memory device detachably attached thereto, the memory device storing print data for identifying the particular image and density data for identifying the particular density, the instructions being configured to, when executed by the processor, cause the processor to:

perform a first printing process to control the thermal head to print a first image on the print medium with a first density;

after the first printing process, store first print data for identifying the first image and first density data for identifying the first density into a first memory device attached to the attachment holder;

when a second memory device storing second print data and second density data is attached to the attachment holder, acquire the second print data and the second density data from the second memory device, the second print data and the second density data having been stored into the second memory device by another printer; and perform a second printing process to control the thermal head to print a second image on the print medium with a second density, the second image being identified based on the acquired second print data, the second density being identified based on the acquired second density data.

* * * * *